US006670311B1

(12) United States Patent
Aldcroft et al.

(10) Patent No.: US 6,670,311 B1
(45) Date of Patent: Dec. 30, 2003

(54) GRANULAR COMPOSITIONS

(75) Inventors: Derek Aldcroft, Cheshire (GB); Stephen Moreton, Cheshire (GB); Mike Halliday, Cheshire (GB); Joseph Brain, Baarn (NL); Richard A Birch, Kent (GB)

(73) Assignee: Quest International BV, Naarden (NL)

( * ) Notice: Subject to any disclaimer, the term of this patent is extended or adjusted under 35 U.S.C. 154(b) by 0 days.

(21) Appl. No.: 09/763,600

(22) PCT Filed: Aug. 4, 1999

(86) PCT No.: PCT/GB99/02569

§ 371 (c)(1),
(2), (4) Date: May 11, 2001

(87) PCT Pub. No.: WO00/12669

PCT Pub. Date: Mar. 9, 2000

(30) Foreign Application Priority Data

Aug. 28, 1998 (GB) ..... 9818782

(51) Int. Cl.[7] ..... C11D 9/44

(52) U.S. Cl. ..... 510/101; 512/4; 428/321.1; 510/438

(58) Field of Search ..... 512/4; 424/401; 428/321.1; 510/101, 438

(56) References Cited

U.S. PATENT DOCUMENTS

| | | | | | |
|---|---|---|---|---|---|
| 4,095,994 | A | * | 6/1978 | Crawford | 106/308 B |
| 5,266,397 | A | * | 11/1993 | Ogawa et al. | 428/323 |
| 5,989,510 | A | * | 11/1999 | Abe et al. | 423/339 |
| 6,001,382 | A | * | 12/1999 | Levy | 424/405 |
| 6,225,524 | B1 | * | 5/2001 | Guarracino et al. | 604/359 |

FOREIGN PATENT DOCUMENTS

| | | | |
|---|---|---|---|
| EP | 0294206 | A2 | 12/1988 |
| EP | 0332259 | A2 | 9/1989 |
| EP | 0820762 | A1 | 1/1998 |
| WO | 94/16046 | | 7/1994 |
| WO | 96/36226 | | 11/1996 |
| WO | WO 97/46189 | * | 12/1997 |

* cited by examiner

*Primary Examiner*—John R Hardee
(74) *Attorney, Agent, or Firm*—Morgan, Lewis & Bockius LLP

(57) ABSTRACT

A granular composition, especially for incorporation in washing powder formulations, comprises at least 40% by weight of an amorphous silica and typically at least 30% by weight of a functional ingredient such as a perfume, the amorphous silica having a surface area of at least 550 $m^2/g$, a pore volume from about 1.0 to about 2.5 ml/g and a particle size of no more than 50 microns, the granules of said composition having a particle size from about 200 to about 2000 microns.

34 Claims, No Drawings

GRANULAR COMPOSITIONS

This application is the national phase of international application PCT/GB99/02569 filed Aug. 4, 1999 which designated the U.S, and that international application was published under PCT Article 21(2) in English.

This invention relates to a granular composition and is particularly concerned with the production of a composition comprising granules with sufficient strength to withstand normal factory/processing handling coupled with the capability to carry a liquid phase, substantially water-free volatile organic active or functional ingredient, such as fragrances or perfumes, flavours, food ingredients and/or cosmetic ingredients. The functional ingredient may be a malodour compound, protein, enzyme, polysaccharide, carbohydrate or antibody. Suitable cosmetic ingredients include insect attractants or repellants, sunscreen compounds, or hair treatment compounds such as hair growth promoters, depilatory, hair straightening and permanent waving materials. The granules, for example, can carry perfume, retain the perfume within its pore system when formulated into a fabric washing powder and disperse, on contact with water, into particles small enough to prevent excess deposition on fabrics or other articles when used in a normal washing cycle. Such granules are intended to allow the intensity of the perfume in the washing powder to be maintained, suppress unwanted perfume loss and function as a delivery system to the wash and/or rinse cycle, fabric or other article.

Perfumes capable of modifying or enhancing the aroma of fabric washing compositions or imparting a more pleasant aroma are well known in the art. U.S. Pat. Nos. 4,131,555 and 4,228,026 are illustrative of prior art disclosing substances which impart a pleasing aroma or fragrance to liquid and granular fabric washing formulations. The described methods of adding the substance are mixing into the liquid formulation or spraying onto the surface of granular fabric washing compositions. It is well recognised that perfumes are volatile and many of the perfume ingredients can be lost from the product during processing or storage or destroyed or damaged by contact with alkaline conditions present in fabric washing compositions or by contact with some of the components of the composition, such as bleaches and enzymes.

Attempts to solve these problems have centred around the use of carriers impregnated with the perfume. EP-A-332259 (Proctor and Gamble) discloses certain perfume particles formed by adsorbing a perfume onto silica. EP-A-332260 (Proctor and Gamble) describes the use of such particles in fabric softening compositions. International Application No. WO94/16046 (Quest International) discloses the use of highly structured precipitated and gel type silicas to convert liquid perfume to a free flowing powder which can be readily formulated into a concentrated fabric washing formulation. In all these prior art examples emphasis is placed on particle size, total pore volume and surface area of the silica particulate since adsorption capacity is of prime importance. EP-A-332259 and EP-A-332260 describe a wide range of silicas with a particle size from 0.001 micron (fumed silica) through to 15 micron (silica gel) and a surface area ranging from 100 to 800 $m^2/g$. For a fabric washing composition the preferred silica is a fumed silica, with a particle size in the range 0.007 to 0.025 micron. Mention is also made that silica gels may be used, the preferred size being 1 to 8 micron. International Application No. WO94/16046 discloses silicas with a particle size of 5–50 microns and a surface area ranging from 100 to 450 $m^2/g$.

EP-A-820762 (Unilever) describes porous silicas which are useful in fabric washing powders and having a particle size greater than 50 microns and a surface area in the range from 100 to 450 $m^2/g$. All of the aforementioned prior art makes no reference to the capability of the adsorbent to carry and retain fragrance through the processing steps used in the manufacture of a fabric washing powder.

EP-A-535942 and EP-A-536942 (Unilever) describe porous inorganic carrier particles, for example silica having at least a pore volume of 0.1 ml/g consisting of pores with a diameter 7 to 50 Å which are stated to be capable of carrying and retaining fragrances. A wide range of particle size is claimed from at least 5 microns up to 500 microns, and it is also disclosed that particles in this size range can also be formed into aggregates of two or more particles to make aggregates of several particle diameters, for example 1000 microns. However, no mention is made as to how this will be achieved and to the properties of the resultant agglomerated particles. It is not certain, for example, from the description of the invention that agglomerates of the preferred particles would still be able to retain fragrance and suppress loss thereof through evaporation. What is certain is that the inorganic carriers referred to, for example microporous silica gels and zeolite Y, have low total porosity and hence poor carrying capacity.

The formation of granules by the agglomeration of finely divided silica has been described in International Patent Applications Nos. WO94/12151 (Unilever) and in WO96/09033 (Crosfield). The former refers to materials suitable for cleansing skin and hair and utilises silica particles which can carry but do not retain fragrance or suppress its evaporation, whilst the latter describes how silicas of mixed structures can be brought together to form agglomerates suitable for imparting a sensory effect to toothpaste.

U.S. Pat. Nos. 5,656,584 and 5,648,328 (Proctor and Gamble) describe processes for producing a particulate laundry additive composition in the form of granules or agglomerates. The process includes mixing the porous carrier, zeolite X and/or zeolite Y or mixtures thereof, typically containing the perfume with an encapsulating material, typically a carbohydrate, and then compacting (U.S. Pat. No. 5,656,584) or extruding (U.S. Pat. No. 5,648,328) the mixture to form agglomerates. The preferred inorganic materials zeolite X and zeolite Y will retain and suppress the fragrance but they have poor carrying capacity when compared with a high porosity silica (pore volume of at least 1 ml/g).

There is a need, therefore, for a granular composition comprising granules having sufficient strength to withstand normal factory/processing handling, the capability to carry a liquid phase, volatile organic, substantially water-free functional ingredient such as perfume, preferably at loadings of at least 30% by weight, to retain the functional ingredient within its pore structure while suppressing evaporative loss and to disperse into particles on contact with water.

According to a first aspect of the present invention there is provided a granular composition for carrying and retaining a liquid phase, substantially water-free, volatile organic functional ingredient, said granular composition comprising at least 40% by weight of an amorphous silica having a surface area of at least 550 $m^2/g$, a pore volume from about 1.0 to about 2.5 ml/g and a particle size of no more than 50 microns (preferably no more than 40 microns and more preferably no more than 30 microns), the granules of said composition disintegrating when contacted with water and having:

a particle size greater than about 200 and up to about 2000 microns, preferably from about 400 to about 1200 microns; and a dry strength such that no more than about 30%, more preferably no more than about 25% and most preferably no more than about 20%, by weight pass through a 212 micron sieve when subjected to the attrition test defined herein.

Typically the amorphous silica constitutes up to about 70% by weight of the composition and the functional ingredient comprises at least 30% by weight of the composition, for instance the functional ingredient may constitute up to-about 60% by weight of the composition.

Preferably the granule composition is such that, on contact with water, from about 50%, preferably from about 60% to about 95% by weight will pass through a 212 micron sieve.

The silica granules preferably have, with respect to the functional ingredient, an absorption capacity of at least 30%, more preferably at least 35%, most preferably at least 40% by weight. The functional ingredient is usually incorporated into the composition by addition to the silica-based granules (preferably while under agitation) until a suitable level of loading is obtained. The actual loading is preferably somewhat less than the maximum achievable and is preferably such that addition of the functional ingredient does not exceed the point beyond which the granules are no longer free flowing.

The amorphous silica, which may either be a silica gel or a precipitated silica, or mixtures thereof, has a high surface area (at least 550 $m^2/g$), and a high pore volume (in the range 1.0 to 2.5 ml/g) so that its porosity is characterised by the presence of a micropore system within a wider-pored mesoporic structure.

The silica particles from which the granules are produced preferably have a particle size of no greater than about 30 microns, e.g. 2 to 30 microns, and a surface area of at least 600 $m^2/g$, more preferably at least 650 $m^2/g$, e.g. up to about 1200 $m^2/g$.

Where the functional ingredient comprises a perfume, it usually consists of one or more perfume components optionally blended with a suitable solvent or diluent. Perfume components and mixtures thereof which can be used for the preparation of such perfumes may be natural products such as essential oils, absolutes, resinoids, resins, concretes etc., and synthetic perfume components such as hydrocarbons, alcohols, aldehydes, ketones, ethers, acids, esters, acetals, ketals, nitriles etc., including saturated and unsatured compounds, aliphatic, carbocyclic and heterocyclic compounds. Examples of such perfume components are: geraniol, geranyl acetate, linalool, linalyl aetate, tetrahydrolinalool, citronellol, citronellyl acetate, dihydromyrcenol, dihydromyrcenyl acetate, tetrahydromyrcenol, terpineol, terpinyl acetate, nopol acetate, 2-phenylethanol, 2-phenylethyl acetate, benzyl alcohol, benzyl acetate, benzyl salicylate, benzyl benzoate, styrallyl acetate, amyl salicylate, dimethylbenzylcarbinol, trichloromethylphenycarbinyl acetate, p-tert, butylcyclohexyl acetate, isononyl acetate, vetiveryl acetate, vetiverol, alpha-n-amylcinammic aldehyde, alpha-hexylcinammic aldehyde, 2-methyl-3-(p-tert.butylphenyl)propanal, 2-methyl-3-(p-isopropylphenyl)propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3-cyclohexenecarbaldehyde, 4-acetoxy-3-pentyltetrahydropyran, methyl dihydrojasmonate, 2-n-heptlcyclopentanone, 3-methyl-2-pentyl-cyclopentanone, n-decanal, n-dodecanal, 9-decenol-1, phenoxyethyl isobutyrate, phenylacetaldehyde dimethyl acetal, phenylacetaldehyde diethyl acetal, geranonitrile, citronellonitrile, cedryl acetate, 3-isocamphylcyclohexanol, cedryl methyl ether, isolongifolanone, aubepine nitrile, aubepine, heliotropine, coumarin, eugenol, vanillin, diphenyl oxide, hydroxycitronellan, ionones, methyl ionones, isomethyl ionones, irones, cis-3-hexenol and esters thereof, indane musk fragrances, tetralin musk fragrances, isochroman musk fragrances, macrocyclic ketones, macrolactine musk fragrances, ethylene brassylate, aromatic nitromusk fragrances. Suitable solvents, dilutents or carriers for perfumes as mentioned above are, for example: ethanol, iso-propanol, diethylene glycol monoethyl ether, dipropylene glycol, diethyl phthalate and triethyl citrate.

As indicated above, the granule composition can be conveniently produced by forming the silica-based granules and then mixing the functional ingredient with the granules. The mixing of the functional ingredient and the granules may be carried out in a variety of ways known to those skilled in the art, for example by spraying the functional ingredient onto the granules in a rotary drum or on a conveyor belt. Non-limiting examples of suitable powder mixers include, Nauter conical mixers, double cone mixers, trough mixers, fluid bed mixers and various rotating blade vessel mixers. In all these mixers, the powder charge is fluidised by paddle, screw air agitation or by mechanical rotation. The functional ingredient, such as perfume oil, is sprayed on to the granules and mixing is continued until the take-up of the functional ingredient to the desired extent is complete (usually so that the granules maintain a free flowing consistency). The functional ingredient-containing granule composition can then be dropped by gravity into suitable containers.

Where the functional ingredient-carrying granules are intended for incorporation in a detergent formulation, it is desirable for the granules, on contact with water or water containing a fabric washing formulation or the like, to disintegrate or disperse readily into particles which are small enough to prevent excess deposition on fabric or articles during a washing cycle.

Granule disintegration or dispersibility into particles is advantageously induced and/or enhanced by the addition of a dispersing agent to the granular composition so as to produce a granule with equivalent "dry" strength to a granule containing no dispersing agent but which, on contact with water, will disintegrate or at least disintegrate more readily than the equivalent dispersing agent-free granule. For instance, in the case of perfume-carrying particles incorporated within a detergent formulation, granule disintegration, within a normal washing cycle, is desirably to such an extent that the resulting particles are small enough to prevent excessive deposition on the fabric or article being washed.

A suitable dispersing agent is one which does not materially affect either the functional ingredient-carrying capacity or the capability of the granular composition to retain the functional ingredient or suppress evaporative loss thereof.

Typically the granular composition contains from about 2 to about 20% by weight of dispersing agent, usually at the expense of the amorphous silica component of the composition.

The dispersing agent is preferably in the form of a water swelling organic particulate material which may be selected from the class of materials known as "super absorbents". Such material preferably has a water swelling capacity of at least 10 ml/g, more preferaby 15 ml/g and most preferably at least 20 ml/g, typically at least 30 ml/g (e.g 50 ml/g or greater).

The water swelling organic particulate may for example be selected from the group consisting of sodium starch glycolates, sodium polyacrylates, cross-linked sodium carboxymethylcelluloses and mixtures thereof. Desirably the particle size of the water swelling organic particulate is less than 100 microns, more preferably less than 50 microns, prior to swelling.

The water swelling organic particulate is conveniently mixed with the amorphous silica and then agglomerated to form granules containing the organic particulate.

Agglomeration of the silica, with or without dispersing agent, may be achieved, for example, by pan granulation, spinning disc, extrusion, spray granulation or by dry compaction.

Preferably, the agglomeration is achieved using a roller compactor which includes a Fitzpatrick Chilsonater commercially available from the Fitzpatrick Company, or an Alexanderwerk roller compactor, commercially available from Alexanderwerk GmbH. Operating conditions are selected on the compactor so that the resultant granule, only containing amorphous silica or formulated to include the water swelling organic particulate at the required composition, has an attrition value (measurement of dry strength) which is low enough to give the granule composition sufficient strength to survive normal factory/process handling. The material to be tested for attrition value needs to be within the preferred size range. This is achieved by subjecting the agglomerates emerging from the compactor to a grinding/comminution device, such as a hammer mill. The resulting particles are screened to provide particles typically in the size range from about 400 to about 1200 microns. After subjecting the granules to the attrition test (as described hereinafter) typically from about 5 to about 30% by weight passes through a 212 micron sieve.

Surprisingly, utilising effective compacting conditions, agglomerates can be prepared containing the water swelling organic particulate that are strong enough to withstand normal factory handling encountered in the production of detergent formulations but disperse, on contact with water, into particles small enough to prevent deposition on fabric or article.

It is desirable for the granule composition to retain the functional ingredient so that losses are minimal during normal factory/processing handling. This benefit can be demonstrated by subjecting the granule composition to a pressure below atmospheric pressure for a period of 24 hours, typically 8 to 10 mbar, and measuring the loss of functional ingredient gravimetrically.

According to a second aspect of the present invention there is provided a granular composition comprising granules of inorganic material carrying a liquid phase, substantially water-free volatile organic functional ingredient, the granules having a functional ingredient retention capability such that from at least about 85% by weight, preferably from about 90% to about 100% by weight of the functional ingredient content in the granule composition, is retained upon exposure of the granule composition to a pressure of about 10 mbar for a period of 24 hours.

Typically the functional ingredient comprises at least about 30% by weight of the composition.

The inorganic material is preferably a silica which may have the properties, e.g. surface area, pore volume, particle size, referred to above. If desired a dispersing agent may be incorporated in the granule composition for the purpose referred to above and the granules of said composition may have a particle size greater than about 200 up to about 2000 microns, preferably from about 400 to about 1200 microns.

A further preferred characteristic of the granular composition according to said first and second aspects of the invention is that the granule composition is capable of readily delivering or releasing the functional ingredient when contacted with water. Thus the granule composition is preferably such that from about 50%, preferably from about 60% to about 95%, by weight of the functional ingredient carried by the granule composition is delivered when contacted with water or water containing a fabric washing composition.

If coloured granules are required then suitable food grade dyes, coloured pigments, for example pigment dispersions under the trade name Monastral (such as Blue BV paste), or Cosmenyl (such as Blue A2R, Green GG) and pigment powders under the trade name of Permanent (such as Carmine FBB 02) or water soluble dyes, such as Patent Blue V, Orange II and Ponceau 4RC, can be added to the granule composition without materially affecting the strength of the granule or its capability to carry and retain fragrance. In applications where the granules are utilised for visual impact, the colour tone and strength are desirably homogeneous throughout the granule composition.

A further aspect of the invention is concerned with a granular composition comprising particles of an inorganic material such as amorphous silica formed into granules together with a dispersing agent for assisting breakdown of the granules upon exposure of the granules to a liquid medium, such as an aqueous medium (e.g. water or water containing a fabric washing formulation), at least a major proportion of said inorganic material being constituted by amorphous silica. The particles of inorganic material, preferably silica gel or a precipitated silica, and the dispersing agent may have any one or more of the characteristics discussed hereinabove.

A granular composition according to the present invention may be used, for example, in the following product areas involving eventual contact between the granules and a liquid medium such as water: namely solid or liquid or gel products for treating or washing textiles or fabrics, oral care products, personal washing products, or application to hard surfaces. Examples include, but are not limited to, abrasive and non-abrasive cleaners, bleach products, fabric conditioners, laundry products, personal wash bars, shampoos, shower gels, foam baths, herbal baths, toothpastes or mouthwashes, bath cubes, bath salts and bath oils. A laundry detergent powder is a particularly preferred application.

In a preferred aspect the invention provides a laundry detergent powder comprising a granular composition as defined in said aspects of the invention referred to hereinbefore, the granular composition preferably incorporating a functional ingredient in the form of a perfume.

The laundry detergent powder can otherwise be generally of conventional composition.

Detergent powders for laundry use span a wide range of compositions. Traditional (or "regular") products are typified by a detergent surfactant level of between 8% and 20% by weight in total, more commonly 10% to 15%. The surfactant may be anionic, non-ionic, cationic, zwitterionic or amphoteric in nature, and commercial products may contain all classes of surfactant, but the predominant form is generally anionic (i.e. anionic surfactants typically account for 50% or more of the total surfactants). Typical detergent surfactants are described in detail in "Surfactant Surface Agents and Detergents", volume II by Schwartz, Perry and Birch, Interscience Publishers (1958). The remainder of a laundry detergent composition generally comprises builders, fillers, moisture, soil release and soil suspension and anti-redeposition agents, and other optional adjuncts such as processing aids, optical brighteners, dyes, foam control agents, anti-corrosion agents, perfumes, pH control agents, enzymes, stabilisers, bleaches and bleach activators. The level of solid components in regular laundry detergent compositions is high, usually above 75%, often above 85%. Perfume loadings for such compositions are generally within the range 0.05% to 0.4%, more commonly 0.1% to 0.3%, and the ratio of solid constituents to organic liquid constituents in a regular detergent composition is usually at least 30:1, and is likely in practice to be considerably higher, e.g. at least 150:1 and up to 500:1.

Laundry detergent powder concentrates and hyperconcentrates (for the purposes of this specification further referred to as "concentrates") represent a relatively new product segment which is assuming increasing commercial importance world-wide. These concentrated products have a rather different composition to those described above.

The total level of detergent surfactant in concentrates generally lies within the range 15% to 60% by weight of the powder, more usually 20% to 40%. In addition to the difference in the level of surfactants another major point of difference concerns the level of low-functionality material such as fillers. In concentrates the level of sodium sulphate, for example, is rarely above 6% or even 2% by weight, whereas in regular powders levels of 20% to 30% are common. The composition of the actives may be similar to that in regular products, i.e. predominantly anionics, but the invention is not restricted to this and for example, a high proportion of non-ionics may be used advantageously. The use of higher proportions of non-ionic surfactants is reported to be a significant trend in the detergent industry, at least for Europe, as reported by Smulders and Krings (Chemistry and Industry, March 1990, pages 160 to 163). Examples of detergent powder formulations with high non-ionics levels are disclosed in EP-A-228011, EP-A-168102, EP-A-425277 and EP-A-120492. Many non-ionic surfactants are liquid at ambient temperatures. Yet another difference between "regulars" and concentrates is that the percentage of perfume incorporated into concentrates tends to be higher than that for regular powder use, and lies generally above 0.1% by weight, normally within the range 0.2% to 2.5% by weight of the powder, more typically 0.4% to 1.5%.

The amount of granular composition of the invention used in laundry detergent powders will typically be to produce perfume levels in the powder in the ranges given above, i.e. 0.05 to 2.5% by weight, with a typical perfume content being about 0.4% by weight.

For use in product formulations containing bleaching agents (which are particularly hostile to perfume components) the perfume is preferably one which is resistant to such attack and retains high performance even when stored in the presence of such hostile ingredients. Non-limiting examples of suitable perfumes are disclosed in EP-A-299561 and U.S. Pat. No. 4,663,068.

Standard Procedures

The granular compositions of the invention are defined in terms of the properties and texture of the amorphous silicas together with the water swelling organic particulate (if present) used to produce the agglomerate, and the granule particle size distribution, strength and dispersibility.

i) Oil Absorption

The oil absorption is determined by the ASTM spatula rub-out method (American Society Of Test Material Standards D, 281). The test is based on the principle of mixing linseed oil with the silica by rubbing with a spatula on a smooth surface until a stiff putty-like paste is formed which will not break or separate when it is cut with a spatula. The amount of oil (O grams) used is then put into the following equation:

$$\text{Oil absorption} = O \times 100 / \text{Wt. of silica sample in grams}$$

i.e. Oil absorption=grams of oil used/100 grams of silica ii) Weight Mean Particle Size The weight mean particle size of the silica is determined using a Malvern Mastersizer model X, with a 45 mm lens and MS15 sample presentation unit. This instrument, made by Malvern Instruments, Malvern, Worcestershire uses the principle of Mie scattering, utilising a low power He/Ne laser. Before measurement the sample is dispersed ultrasonically in water for 5 minutes to form an aqueous suspension. This suspension is stirred before it is subjected to the measurement procedure outlined in the instruction manual for the instrument, utilising a 45 mm lens in the detector system. The Malvern Mastersizer measures the weight particle size distribution of the silica or reference material. The weight mean particle size (d50) or 50 percentile, the 10 percentile (d10) and the 90 percentile (d90) are readily obtained from the data generated by the instrument.

iii) Loose Bulk Density

Loose bulk density is determined by weighing approximately 180 ml of silica into a dry 250 ml measuring cylinder, inverting the cylinder ten times to remove air pockets and reading the final settled volume.

$$\text{Loose bulk density} = (\text{Weight} \times 1000)/\text{Volume g/liter}$$

iv) BET Surface Area

Surface area is determined using standard nitrogen adsorption methods of Brunauer, Emmett and Teller (BET), using a single point method with a Sorpty 1750 apparatus supplied by Carlo Erba company of Italy. The sample was outgassed under vacuum at 270° C. for 1 hour before measurement.

v) Particle Size Distribution By Sieve Analysis

Particle size distribution of the granular composition and the dispersing agent is carried out using sieve analysis. 100 g of the sample is placed on the top sieve of a series of BS sieves, at approximately 100 micron intervals between 100 and 1500 microns. The sieves are arranged in order with the finest at the bottom and the coarsest at the top of the stack. The sieves are placed in a mechanical vibrator, for example, Inclyno Mechanical Sieve Shaker by Pascall Engineering Co Ltd., covered with a lid and shaken for 10 minutes.

Each sieve fraction is accurately weighed and the results calculated:

$$\% \text{ residue} = (\text{weight of residue} \times 100)/\text{weight of sample}$$

To determine the particle size distribution of the water swelling organic particulate, sieve sizes in the range 30 to 110 microns are selected in intervals varying between 10 and 25 microns. Typically 10 g is placed in the top, coarsest sieve and the procedure described for measuring the particle size distribution of the granule repeated.

vi) Fragrance Carrying Capacity 20.0 grams of granules are placed in a 100 ml beaker. Using a disposable pipette, limonine (available from Quest International), a substitute for perfume, is dripped onto the granules and stirred in with a spatula. As the granules absorb the limonine there comes a point at which the granules are saturated with perfume, i.e. the point at which they can absorb no more. At this point they rapidly change from a free-flowing powder to a sticky, damp mass in which the granules clump together. The point at which this happens is the end point. The sample is weighed and the weight of limonine added determined. The result may be expressed as grams limonine per 100 grams granules or as % limonine in the saturated limonine-granules mixture.

vii) Dry Strength (Attrition Test)

The dry strength is determined by a method based on attrition of the granules in a high-shear mixer. A control is first carried out to determine the % by weight of fines (<212 microns) already present or generated by the sieving process. For the control approx. 20 grams of unperfumed, accurately weighed, granules is sieved for 10 minutes over a 212 micron sieve on a laboratory sieve shaker. The % by weight of material passing the 212micron sieve is recorded. For the test, 20.0 grams of unperfumed granules are placed in a Sirman CV6 food processor (available from Metcalfe Catering Equipment, Bleanau Ffestiniog, Gwyndd, Wales) and the processor turned on at maximum speed (2100 revs./min.) for one minute. The sample is sieved for 10 minutes as before and the % by weight passing the 212 micron sieve measured. The % by weight already less than 212 micron (the control) is subtracted to obtain the attrition value.

viii) Wet Breakdown Test

To determine the extent the granules break down in water a control is first carried out according to the procedure above to determine the % by weight of fines less than 212 micron already present so that it can be deducted from the test result. For the test the granules are loaded with fragrance to a level close to their maximum carrying capacity but without impairing free flow capacity. The fragrance used for the first method is "fragrance A" from Quest International. The formulation of this is given in the fragrance retention test section below. The sample is allowed to rest for 12–24 hours to allow the perfume to distribute evenly throughout the granules. 1 gram of the perfumed sample is mixed with 9 grams of a washing powder (Radion Automatic) and placed in a 2 liter plastic bottle (about 24 cm tall and 12 cm diameter) and one liter hot water (ca. 40–50° C.) added. Four such bottles are loaded, in a row, into a cage which can be rotated about its longitudinal axis so that the bottles are rotated end over end. The rotation of the cage is driven at a speed of 34 revolutions a minute by an electric motor. After 20 minutes of this rotatory mixing, the bottles are removed and the contents of each poured through a 212 micron sieve. The bottles are rinsed out with water and the rinses poured through the sieve. The residue on the sieve represents the portion of the original sample that has not broken down to less than 212 microns. The residue is rinsed into a beaker, the excess water decanted, the sample dried at 145° C. and weighed. The result is expressed as % by weight of the granules (minus fragrance) passing the 212 micron sieve. The higher the number the more the sample has disintegrated in contact with the aqueous media.

ix) Fragrance Retention

Two methods have been developed to demonstrate the retention of fragrance by granules. The first method is based on weight loss in a vacuum whilst the second measures the fragrance remaining after two weeks of storage in a washing powder. The fragrance for the first method used for the first method is "fragrance A" from Quest. This has the composition below:

| Ingredient | wt. % |
|---|---|
| Anther (Q) | 1.0 |
| Coumarin | 2.0 |
| Gyrane (Q) | 0.5 |
| Hexyl cinnamic aldehyde | 18.0 |
| Jasmacyclene (Q) | 5.0 |
| Jasmopyrane Forte (Q) | 4.0 |
| Lilial (G) | 10.0 |
| Lixetone (Q) | 8.0 |
| Methyl iso alpha ionone | 5.0 |
| 4-tert. butylcyclohexyl acetate | 5.0 |
| 2-phenylethyl alcohol | 15.0 |
| Pivacyclene (Q) | 0.5 |
| Tetrahydrolinalol | 6.0 |
| Trascolide (Q) | 20.0 |

"Q" and "G" respectively denote trade marks of the Quest Group of Companies and Givaudan.

A small sample (ca. 10 grams) of granules loaded to close to its carrying capacity with "fragrance A" is prepared by dripping fragrance onto the granules and gently mixing it in, the amount of fragrance used being such that the free flowing property of the granules is not impaired. The sample is allowed to stand overnight to enable the fragrance to disperse uniformly throughout it. 5.0 grams of the sample is accurately weighed in a 4 cm. diameter Petri dish and placed in a vacuum desiccator. The desiccator is connected to a high vacuum pump and evacuated to a pressure of 8–10 mbar and maintained at this level. At intervals of 4, 7 and 24 hours the sample is removed for weighing and then replaced. At first a rapid weight loss occurs, due mostly to loss of moisture (and to a lesser extent loss of the more volatile components of the fragrance). After this, the loss is much more gradual and represents loss of fragrance with only a minor contribution from residual water. Experiments with unfragranced granules show that for silicas typically 50–80% of the water is lost in the first 4 hours.

Additionally, with fragranced granules, it is possible to trap the volatiles being evaporated using liquid nitrogen. By this means it can be shown that the material trapped in the first few hours consists of a mixture of aqueous and organic liquids. At later times only the perfume is collected.

As the water only constitutes a few percent of the total volatile content of the perfumed granules (typically <10%), and is mostly lost within the first few hours, the contribution to the overall weight loss by the evaporation of water will be negligible after 7 hours. Accordingly it is the weight loss between the 7 and 24 hours measurements that affords the most accurate measure of fragrance loss by evaporation. By taking the % weight lost at 24 hours and subtracting the corresponding value at 7 hours the weight loss over the 7–24 hour period is thereby obtained. Dividing by 17 (the length, in hours, of this period) gives the rate of perfume loss in % available perfume per hour, multiplying by 24 then gives the weight % of available perfume lost in the 24 hour period with the contribution from moisture largely removed. Subtracting this value from 100% gives the % by weight of perfume retained.

The second method uses a mixture of 10 fragrance ingredients selected to cover a range of functionalities and volatilities. Granules were loaded with this ten-component fragrance mix. The fragrance mix was a mixture of equal proportions of common perfume ingredients selected to represent a range of functional groups and to avoid co-elution during gas chromatography (GC) analysis. It was not formulated to have a pleasant smell. The ingredients were: Limonine, Linalol, Terpineol Alpha, Anisic Aldehyde, Herbanate, Dodecyl Nitrile, Diethyl Phthalate, Hexyl Salicylate, Hexyl Cinnamic Aldehyde, Tonalid 2. These are obtainable from Quest International. To this mix a small quantity of a solvent dye (for example, 0.1% Solvent Red 24) was added to impart a bright colour and the dyed perfume mix was then added to the granules up to a level close to their carrying capacity. The perfumed granules were then blended into a washing powder formulation.

50 g of the granule/washing powder mixture was stored for two weeks at 45° C. in sealed glass jars. After this time the jars were opened and ca.0.01 g of the granules, identified by their colour, picked out using tweezers and analysed by GC to determine the amounts of the various perfume components remaining in them. The % of each component present as a percentage of the original was determined and an overall average value calculated. The result was expressed as the amount of perfume retained as a percentage of the original.

x) Fragrance Release

For demonstrating the rapid release of fragrance in water, "fragrance A" was first coloured with a little solvent dye (D & C Green no. 6 added at about 40 mg per 100 ml fragrance). Granules were loaded to around their carrying capacity (but without free flow impairment) with the coloured fragrance and then 10.0 grams of the granules were added to approx. 80 ml water in a 100 ml measuring cylinder. The water rapidly displaced the fragrance which rose to the surface as an oil. The dye imparted an intense blue/green colour to the fragrance making it readily visible as an oily layer on the surface. Agitation with a stiff wire, or by blowing bubbles through the mixture with a pipette, helped free trapped globules of fragrance. After about five minutes of agitation the mixture was left to settle for another ten minutes after which time the volume of fragrance was read off using the graduations on the side of the cylinder. From the specific gravity of the fragrance (0.96), the % by weight of available fragrance that has been released can be calculated.

xi) Swelling of Organic Particulate Dispersing Aid

To demonstrate the swelling ability of the organic dispersing aid, 19.6 g of the material was blended with 0.4 g of ultramarine pigment and compressed into a tablet using a laboratory tablet press at about 2500 atmospheres pressure to give a tablet 32 mm in diameter. This was crushed and sieved to give granules 500–1000 $\mu$ in size. A glass tube, 33 mm in internal diameter and about 30 cm long with a sintered porous glass disc (porosity 1) fitted at one end was immersed upright, with said one end lowermost, in a large beaker of water (at 25° C.) so that the water level rose to about 14 cm above the sintered glass. 1 g of granules was added to the tube and allowed to settle onto the sintered glass disc. With this arrangement water has access to the granules from both above and below. The granules immediately began to swell, forming a jelly-like mass. The ultramarine pigment imparted a blue colour to the mass making it easy to see the top and to record its height. The height of the swelling mass was recorded at intervals and showed an initial rapid rise followed by a levelling off after about 20–30 minutes. From the diameter of the tube, the volume of the swollen mass can be calculated. The result may be expressed as ml/g organic particulate after a fixed time (e.g. 20 minutes).

The invention will now be illustrated by way of Reference Examples based on prior art together with non-limiting Examples of the invention.

Reference Examples 1 to 4 (Prior Art)

Examples from the following prior art have been repeated:

EP-A-820762, Silica 4—Reference Example 1

WO96/0903, Composition 3—Reference Example 2

U.S. Pat. No. 5,656,584, Example 2—Reference Example 3

JP-A-62072797, Example—Reference Example 4

All the variables highlighted as being important in the prior art examples were followed, as closely as can be achieved by those skilled in the art, according to the teaching of the prior art patents. The compositions utilised are listed in Table 1 and where more than one component was used the powdered materials were blended together before agglomerating.

Reference Examples 1 and 2 were prepared by so-called "wet" agglomeration. Deionised water was added to powder mixes to give a water solids ratio of 1.33 to 1 and the resulting 200 g blends were agglomerated using a laboratory scale Sirman CV6 blender, supplied by Metcalfe Catering Equipment Ltd., Blaenau Ffestiniog, Wales. The resulting wet agglomerates were then dried in an oven at 150° C. for 4 to 6 hours, gently forced through a 1000 micron screen and screened to the required particle size distribution.

Reference Examples 3 and 4 were made by "dry" agglomeration. The particles are brought into contact with each other by either compressing the powder bed in a tablet press or between the rollers of a compactor. In Reference Examples 1, 2 and 4, perfume was added to the previously made granules. For Reference Example 3, perfume was already present in the mixture prior to compacting into granules, in accordance with the method described in the relevant patent.

TABLE I

| Ingredient | REF. 1 EP 820762 | REF. 2 WO 9609033 | REF. 3 US 5656584 | REF. 4 JP 62072797 |
|---|---|---|---|---|
| TC15 | 100 | 40 | — | — |
| AC77 | — | 60 | — | — |
| zeolite X | — | — | 44.5 | — |
| zeolite 4A | — | — | — | 100 |
| Sucrose | — | — | 44.5 | — |
| Perfume | — | — | 11 | — |

The properties of the materials used to prepare the reference examples are given in Table II.

TABLE II

| Property | Sorbosil TC15 | Sorbosil AC77 | zeolite 4A | zeolite X |
|---|---|---|---|---|
| Surface Area m2/g | 260 | 120 | 10 | 850 |
| Pore Volume ml/g | 2 | 0.6 | 0 | 0.3 |
| Particle Size microns | 12 | 10 | 4 | 2 |
| Moisture Content % w/w | 5 | 7 | 13 | 15 |

Table III lists the properties of the granule compositions of the repetitions. In the Reference Examples carrying capacity is expressed as % perfume in granules saturated with perfume; retention is expressed as % of available perfume retained after 24 hours at 8–10 mbar; attrition is given as %<212 microns; dispersion as %<212 microns. All percentages are weight %.

It can be seen that none of the Reference Examples have the required balance of properties. The granule compositions containing amorphous silicas have good carrying capacity but are too strong to disperse into particles small enough to prevent deposition on fabric or an article. The zeolite granule compositions have poor carrying capacity. Not surprisingly the zeolite granule composition containing nearly 50% sucrose disperses when contacted with water, but as will be demonstrated in the examples of this invention its dispersibility is inferior to granule compositions containing the water swelling organic particulate.

TABLE III

| Patent | Ref Example | Carrying | Retention | Attrition | Dispersion |
|---|---|---|---|---|---|
| EP 820 762 | 1 | 57 | 85 | 4 | 0 |
| WO 9609033 | 2 | 40 | 85 | 39 | 11 |
| US 5656584 | 3 | 11 | 76 | 6 | 53 |
| JP 62072797 | 4 | 22 | 79 | 13 | 10 |

Specific Description of the Invention

Examples of the preparation of the granule compositions will now be given to illustrate but not limit the invention. Unless otherwise-stated, Examples were prepared by blending the dry ingredients in a Pek mixer (George Tweedy & Co of Preston—28lb S.A. Machine) and compacting on a roller compactor (Alexanderwerk WP50—manufactured by Alexanderwerk AG, D 5630 Remscheid 1, Germany). The preparative method is now described in detail.

Silica and water swelling organic particulate were blended together, in the appropriate proportions, in a Pek mixer for 30 minutes. Optionally, if a coloured product is desired, a masterbatch of coloured silica is prepared first. This masterbatch is then added to the silica and organic particulate in the Pek mixer and the ingredients mixed for 30 minutes. The proportion of colorant in the masterbatch and the proportion of masterbatch in the overall mix are calculated to give a product with the desired level of colorant (typically <5%, preferably <1%) using 1–25%, preferably 2–15%, by weight masterbatch in the overall mix.

A minimum of 2 kg of blended material, prepared as described above, is compacted by feeding into an Alexanderwerk roller compactor, fitted with a sintered block vacuum deaeration system. The settings used for the preparation of the Examples in this patent were: roller speed 2, screw feeder 2, vacuum 0.8, stirrer speed 2. The roller pressure setting was varied according to the strength of granule desired, higher pressures leading to stronger granules as defined by their attrition value. The roller pressure used. in the Examples was 100 bar unless otherwise stated.

The compacted material from the compactor was fed into a granulator, which forms part of the machine, and forced through a 1.2 mm mesh. The resulting granules were then screened to the desired particle size range using standard laboratory sieves. The particle size range used for the Examples below was 500–1000 microns unless otherwise stated. Where perfume needs to be added to the granules, it is added dropwise under gentle agitation until the desired loading is secured, the samples then being left to equilibriate for 24 hours.

EXAMPLE 1

The amorphous silica SD 2255 (obtainable from Crosfield Limited of Warrington, England) was blended together with Vivastar P5000 in the matrix listed in Table IV, agglomerated in the roller compactor, comminuted and screened to the particle size specified above. Vivastar P5000 is a sodium starch glycolate obtainable from J. Rettenmaier & Sohne, Germany.

TABLE IV

| Ingredient | Example 1A | Example 1B | Example 1C | Example 1D | Example 1E |
|---|---|---|---|---|---|
| SD2255 | 100 | 98 | 95 | 90 | 85 |
| Vivastar | 0 | 2 | 5 | 10 | 15 |

The properties of the silica and the Vivastar P5000 are given in Table V. It can be seen that the amorphous silica SD 2255 exhibits both high surface area and high pore volume indicating that the mesopore structure responsible for this observed increase in porosity contains micropores.

TABLE V

| Property | SD2255 | Vivastar P5000 |
|---|---|---|
| Surface Area m2/g | 650 | NM |
| Pore Volume ml/g | 1.3 | NM |
| Average Particle Size microns | 5 | <45 |
| Moisture Content % w/w | 5 | 5 |
| Oil absorption g/100 g | 228 | NM |

In the above Table and elsewhere in this specification, NM indicates "not measured".

The properties of the agglomerates are listed in Table VI. In the Table, carrying capacity is expressed as % perfume in granules saturated with perfume; retention is expressed as % of available perfume retained after 24 hours at 8–10 mbar; attrition is given as %<212 microns; dispersion as %<212 microns and perfume release as % available perfume after 15 minutes contact with water. All percentages are weight %.

Example 1A contains no Vivastar. The data obtained on Examples 1B to 1E show that the addition of Vivastar P5000 has no detrimental effect on particle strength, carrying capacity and perfume retention. It can be seen that as the levels of Vivastar are increased, the granule composition disperses more readily into particles small enough to pass through a 212 micron sieve. A high level of perfume is released into the aqueous phase independent of both the strength and dispersibility of the granule composition.

TABLE VI

| Example | Carrying capacity | Perfume retention | Attrition | Dispersion | Perfume release |
|---|---|---|---|---|---|
| 1A | 37 | 93 | 14 | 25 | 80 |
| 1B | 37 | | 12 | 35 | |
| 1C | 34 | | 13 | 55 | |
| 1D | 36 | 96 | 14 | 82 | 80 |
| 1E | 36 | | 10 | 82 | |

EXAMPLE 2

The amorphous silica SD2311 (obtainable from Crosfield Limited, UK) was blended with Vivastar P5000 according to the Examples given in Table VII and compacted on the roller compactor and screened to the required particle size.

TABLE VII

| Ingredient | Example 2A | Example 2B | Example 2C | Example 2D |
|---|---|---|---|---|
| SD2311 | 100 | 98 | 90 | 85 |
| Vivastar | 0 | 2 | 10 | 15 |

The properties of the silica and the Vivastar P5000 are given in Table VIII. The silica used in this Example SD 2311 exhibits higher surface area and higher pore volume than SD2255 indicating the presence of a wider pore structure containing an even greater presence of micropores.

TABLE VIII

| Property | SD2311 | Vivastar P5000 |
|---|---|---|
| Surface Area m2/g | 850 | NM |
| Pore Volume ml/g | 1.8 | NM |
| Average Particle Size microns | 25 | <45 |
| Moisture Content % w/w | 8 | 5 |
| Oil Absorption g/100 g | 280 | NM |

The properties of the agglomerates are listed in Table IX. In this Table, carrying capacity is expressed as % perfume in granules saturated with perfume; retention is expressed as % of available perfume retained after 24 hours at 8–10 mbar; attrition is given as %<212 microns; dispersion as %<212 microns and perfume release as % available perfume after 15 minutes contact with water. All percentages are weight %.

Example 2A contains no Vivastar. The experimental data measured for Compositions 2B to 2D show that the addition of Vivastar P5000 has no detrimental effect on particle strength, carrying capacity and perfume retention. As is the case in Example 1, it can be seen that as the levels of Vivastar are increased the granule composition disperses more readily into particles small enough to pass through a 212 micron sieve. A high level of perfume is released into the aqueous phase independent of both the strength and dispersibility of the granule composition.

TABLE IX

| Example | Carrying capacity | Perfume retention | Attrition | Dispersion | Perfume release |
|---|---|---|---|---|---|
| 2A | 37 | 96 | 12 | 12 | 70 |
| 2B | 36 | | 14 | 34 | |
| 2C | 35 | 95 | 9 | 79 | 75 |
| 2D | 36 | | 9 | 82 | |

EXAMPLE 3

To demonstrate the capability of different classes of water swelling organic particulates to act as dispersing agents a range of granule compositions was prepared containing 9 parts SD 2255 and 1 part organic particulate. Table X lists the properties and suppliers of the water swelling organic particulates utilised to prepare the granule compositions.

TABLE X

| Example | Ingredient | APS* microns | Classification | Supplier |
|---|---|---|---|---|
| 3A | SD2255 | 5 | Amorphous silica | Crosfield Ltd, Warrington, UK |
| 3B | Vivastar | <45 | Sodium starch glycolate | J. Rettenmaier & Sohne, Germany |
| 3C | Ac-Di-Sol SD-711 | <32 | Sodium croscarmellose | FMC Corporation, Philadephia, USA |
| 3D | Primojel | <45 | Sodium starch glycolate | Avebe, Netherlands |
| 3E | Salsorb | <45 | Sodium polyacrylate | Allied Colloids, Bradford, UK |
| 3F | Aquasorb | ca 40 | Sodium carboxymethyl-cellulose | Hercules Ltd., Salford, UK |

*In the above table, APS is Average Particle Size

The properties of the granule compositions are given in Table XI. In the table carrying capacity is expressed as % perfume in granules saturated with perfume; retention is expressed as % of available perfume retained after 24 hours at 8–10 mbar; attrition is given as %<212 microns; dispersion as %<212 microns. All percentages are weight %. Example 3A contains no organic particulate. It can be seen that the granule composition containing Ac-Di-Sol SD-711 (Example 3C) gives the best balance of properties, followed by the granule compositions utilising Vivastar and Primogel as the dispersing aid (Examples 3B and 3D). All the granule compositions containing organic particulate show improved dispersibility when compared to the control. The high carrying capacity of granule composition 3E is attributable to using a lower compaction pressure, see Example 6.

TABLE XI

| Example | Carrying capacity | Retention | Attrition | Dispersion |
|---|---|---|---|---|
| 3A | 37 | 93 | 14 | 25 |
| 3B | 35 | 95 | 9 | 79 |
| 3C | 36 | 98 | 8 | 93 |
| 3D | 35 | 99 | 10 | 70 |
| 3E | 47 | 95 | 15 | 58 |
| 3F | 30 | 100 | 8 | 78 |

EXAMPLE 4

It is clear in Example 3 that the water swelling organic particulate Ac-Di-Sol is the most effective dispersing aid of those illustrated. The purpose of Example 4 is to investigate the effect of varying the concentration of the organic particulate on the properties of the granule compositions. Blends of SD2255 with Ac-Di-Sol were made according to matrix listed in Table XII, compacted in the roller compactor, comminuted and screened to the previously specified particle size.

TABLE XII

| Ingredient | Example 4A | Example 4B | Example 4C | Example 4D |
|---|---|---|---|---|
| SD2255 | 100 | 98 | 95 | 90 |
| Ac-Di-Sol | 0 | 2 | 5 | 10 |

The properties of the granule compositions are given in Table XIII. In the Table, carrying capacity is expressed as % perfume in granules saturated with perfume; retention is expressed as % of available perfume retained after 24 hours at 8–10 mbar; attrition is given as %<212 microns; dispersion as %<212 microns. All percentages are weight %.

Example 4A contains no organic particulate. It can be seen that even at a concentration of 2%, Ac-Di-Sol SD-71 1 gives rise to a reasonable balance of properties.

TABLE XIII

| Example | Carrying capacity | Retention | Attrition | Dispersion |
|---|---|---|---|---|
| 4A | 37 | 93 | 14 | 25 |
| 4B | 36 | 95 | 11 | 52 |
| 4C | 36 | | 9 | 76 |
| 4D | 36 | 98 | 8 | 93 |

EXAMPLE 5

The size of particle used to prepare the agglomerate can affect strength and dispersibility. Vivastar P5000 was screened into various size fractions and combined with two different sizes of the silica SD 2255 in the composition matrix listed in Table XIV. A coarser silica product SD 2255A (obtainable from Crosfield Limited, UK) was obtained by comminuting the gel feedstock to a larger particle size. The granule compositions were prepared on a roller compactor, comminuted and screened to the specified particle size.

TABLE XIV

| Ingredient | Particle size (microns) | Example 5A | Example 5B | Example 5C | Example 5D |
|---|---|---|---|---|---|
| Vivastar | <45 | 10 | — | — | 10 |
| Vivastar | 45–63 | — | 10 | — | — |
| Vivastar | 63–75 | — | — | 10 | — |
| SD2255 | 5 | 90 | 90 | 90 | — |
| SD2255A | 11 | — | — | — | 90 |

The properties of the agglomerates are listed in Table XV. In the table carrying capacity is expressed as % perfume in granules saturated with perfume; retention is expressed as % of available perfume retained after 24 hours at 8–10 mbar; attrition is given as %<212 microns; dispersion as %<212 microns. All percentages are weight %.

TABLE XV

| Example | Carrying Capacity | Retention | Attrition | Dispersion |
|---|---|---|---|---|
| 5A | 36 | 96 | 10 | 92 |
| 5B | | | 11 | 84 |
| 5C | | | 12 | 70 |
| 5D | 43 | 96 | 14 | 66 |

Example 5A contains SD2255 and Vivastar P5000 at a particle size used in the previous Examples. The experimental data measured for Examples 5B to 5D show that reducing the particle size of Vivastar has a beneficial effect on the dispersibility of the granule composition. Comparison between the properties of Example 5A and Example 5D shows the dispersibility of the granule composition increases as the particle size of the amorphous silica is reduced. There is no detrimental effect on attrition and there is an indication that carrying capacity improves as the particle size of the amorphous silica increases.

EXAMPLE 6

In Example 3 reference is made to the effect of the compacting pressure on the roller compactor. Here the effect of roller compacting pressure, together with particle size of the amorphous silica and concentration of water swelling organic paticulate in the granule is investigated in the experimental design matrix listed in Tables XVIA & B, respectively. The amorphous silicas (SD2255, SD2255A) were blended with Vivastar according to the compositions given in Tables XIVA & B and compacted on the roller compactor at two compacting pressures, 60 and 100 bar, respectively, comminuted and screened to the specified particle size.

TABLE XVIA

| Ingredient | Example 6A | Example 6B | Example 6C | Example 6D |
|---|---|---|---|---|
| SD2255 | 95 | 95 | 90 | 90 |
| Vivastar | 5 | 5 | 10 | 10 |
| Pressure (bar) | 60 | 100 | 60 | 100 |

TABLE XVIB

| Ingredient | Example 6E | Example 6F | Example 6G | Example 6H |
|---|---|---|---|---|
| SD2255/A | 95 | 95 | 90 | 90 |
| Vivastar | 5 | 5 | 10 | 10 |
| Pressure (bar) | 60 | 100 | 60 | 100 |

The properties of the granule compositions are given in Table XVII. In the table carrying capacity is expressed as % perfume in granules saturated with perfume; retention is expressed as % of available perfume retained after 24 hours at 8–10 mbar; attrition is given as %<212 microns; dispersion as %<212 microns. All percentages are weight %.

TABLE XVII

| Example | Carrying | Attrition | Dispersion |
|---|---|---|---|
| 6A | 42 | 17 | 52 |
| 6B | 34 | 13 | 55 |
| 6C | 42 | 19 | 82 |
| 6D | 36 | 14 | 82 |
| 6E | 50 | 22 | 43 |
| 6F | 43 | 12 | 43 |
| 6G | 52 | 26 | 73 |
| 6H | 43 | 14 | 66 |

It can be seen that in each case increasing the compacting pressure has a beneficial effect on attrition value of the granule composition but diminishes its carrying capacity. Surprisingly little effect, if any, is seen on the dispersibility of the granule compositions.

EXAMPLE 7

To demonstrate the effectiveness of the water swelling organic particulates as dispersing aids a series of granule compositions were prepared according to the composition matrix listed in Table XVIII. The granule compositions were prepared on the roller compactor, comminuted and sieved to the specified size range.

TABLE XVIII

| Ingredient | Example 7A | Example 7B | Example 7CA | Example 7D |
|---|---|---|---|---|
| SD2255 | 90 | — | 90 | 90 |
| SD2311 | — | 90 | — | — |
| Ac-Di-Sol | 10 | — | — | — |
| Vivastar | — | 10 | — | — |
| Primojel | — | — | 10 | — |
| Aquasorb | — | — | — | 10 |

As described in the methods section for the dispersibility test, the granule composition is contacted with water and shaken for 20 minutes. To illustrate the improved dispersibility imparted to the granule compositions by the organic particulate the time during which the sample is shaken was reduced in stages from 20 to 2 minutes. The measurements obtained are summarised in Table XIX.

TABLE XIX

| Example | Time (minutes) | Dispersion |
|---|---|---|
| 7A | 2 | 83 |
| 7A | 5 | 86 |
| 7A | 10 | 91 |
| 7A | 20 | 93 |
| 7B | 2 | 55 |
| 7B | 5 | 59 |
| 7B | 10 | 65 |
| 7B | 20 | 78 |
| 7C | 2 | 42 |
| 7C | 5 | 52 |
| 7C | 10 | 58 |
| 7C | 20 | 71 |
| 7D | 2 | 61 |
| 7D | 5 | 66 |
| 7D | 10 | 68 |
| 7D | 20 | 73 |

It can be seen that in most cases dispersion is rapid, most of it happening within two minutes of exposure to the test conditions.

EXAMPLE 8

To demonstrate the relationship between the propensity of the water swelling particulates to expand when contacted with water and the level of dispersibility imparted to the granule composition, a series of granule compositions was prepared containing 1 part of organic swelling agent and 9 parts by weight of SD2255. The compositions were compacted on the roller compactor, together with controls containing no organic particulate, comminuted and screened to the specified particle size distribution. The properties of the agglomerates, together with the swelling capacity of granules of pure dispersant as described in Standard Procedures, recorded after contacting the organic particulate with water for 20 minutes are listed in Table XX. In the Table, dispersibility is expressed as the % by weight passing through a 212 micron sieve.

TABLE XX

| Dispersant | Swelling (ml/g after 20 mins.) | Dispersion | Control Dispersion |
|---|---|---|---|
| Vivastar | 54 | 82 | 25 |
| Primojel | 17 | 70 | 25 |
| Ac-Di-Sol | 15 | 93 | 25 |

TABLE XX-continued

| Dispersant | Swelling (ml/g after 20 mins.) | Dispersion | Control Dispersion |
|---|---|---|---|
| Aquasorb | 21 | 78 | 25 |
| Salsorb | 163 | 58 | 30 |
| Arbocel | 9 | 30 | 22 |
| Maize starch | 3 | 30 | 25 |

Arbocel is a trademark, the product being available from J. Rettenmaier & Sohne. Maize starch can be obtained from National Starch Corporation, New Jersey, USA.

The last two materials are examples of potential organic swelling particulates which were found not to work in this application. It can be seen that water swelling organic particulates having swelling capacities greater than 10 ml/g impart dispersibility levels in excess of 50% to the granules. Whilst other factors may also be important, such as particle size and shape, the swelling property appears to afford a suitable guide in the identification of organic particulates that impart the desired levels of dispersion.

EXAMPLE 9

The perfume retention data cited in Examples 1 to 4 has been determined by measuring weight loss on exposing the granule composition containing perfume to a pressure less than atmospheric pressure. In this Example perfume retention of the granule composition in contact with a typical fabric washing powder is compared with that obtained by exposing the granules to reduced pressure. To 50 g of a typical washing powder formulation (Table XXI), sufficient granule composition containing perfume is added to give a perfume concentration of 0.4% by weight.

TABLE XXI

| Ingredient | weight % |
|---|---|
| zeolite 4A | 29.8 |
| Sodium perborate monohydrate | 15.6 |
| Sodium carbonate | 9.7 |
| TAED granules* | 8.2 |
| Dobanol 23 - 3 | 8.7 |
| Dobanol 23 - 6.5 | 7.3 |
| Sodium LAS | 5.1 |
| Polyacrylate (mw 3000–4000) | 3.1 |
| Sodium sulphate | 1.6 |
| Perfumed granules | 1 |
| Sodium soap | 1.5 |
| Sodium silicate | 1.5 |
| Enzymes | 0.8 |
| Anti-redeposition agent | 0.4 |
| Sodium EDTA | 0.3 |
| Antifoam | 0.3 |
| Water, dye, minor components | 5.1 |
| Total | 100 |

*tetraacetylethylene diamine sodium salt

The powder containing the perfumed granules was sealed in jars and stored for 2 weeks at 45° C. The amount of perfume remaining in selected granules was determined by gas chromatography. A more detailed description of the method is given under standard procedures. Table XXII summarises the data obtained by the two methods for determining perfume retention. It can be seen that although the values obtained by analysing the granules which have been in contact with the washing powder are much lower than those than those determined by measuring weight loss at reduced pressure the data show the same trends, in that those compositions which give highest perfume retention values when exposed to a pressure less than atmospheric pressure also give the highest values in the storage test when contacted with a fabric washing powder.

TABLE XXII

| Example | Composition | Retention in vacuum. | Retention in washing powder |
|---|---|---|---|
| 1A Invention | SD2255 | 93 | 20 |
| 3A Invention | SD2311 | 96 | 30 |
| Ref. 1 Prior art | TC15 | 85 | 10 |
| Ref. 2 Prior art | TC15/AC77 | 85 | 3 |
| Ref. 4 Prior art | 4A zeolite | 79 | <1 |

What is claimed is:

1. A granular composition for carrying and retaining a liquid phase, substantially water-free, volatile organic functional ingredient, said granular composition comprising at least 40% by weight of an amorphous silica and the amorphous silica having a surface area of at least 550 $m_2/g$, a pore volume from about 1.0 to about 2.5 ml/g and a particle size of no more than 50 microns, the granules of said composition disintegrating when contacted with water and having:

a particle size greater than from 200 and up to 2000 microns; and a dry strength such that no more than 30% by weight pass through a 212 micron sieve when subjected to the attrition test defined herein.

2. A granular composition as claimed in claim 1 in which the granules have a particle size from 400 to 1200 microns.

3. A granular composition as claimed in claim 1 in which the amorphous silica constitutes up to 70% by weight of the composition.

4. A granular composition as claimed in claim 1 in which a functional ingredient is present in an amount of at least 30% by weight of the composition.

5. A granular composition as claimed in claim 4 in which the functional ingredient comprises up to 60% by weight of the composition.

6. A granular composition as claimed in claim 1 in which the composition is in the form of free-flowing granules carrying said functional ingredient.

7. A granular composition as claimed in claim 1 in which the silica granules have a functional ingredient absorption capacity of at least 35% by weight.

8. A granular composition as claimed in claim 1 in which the silica granules have a functional ingredient absorption capacity of at least 40% by weight.

9. A granular composition as claimed in claim 1 in which the granular composition contains a dispersing agent for enhancing dispersion of the granules as small particles on contact with water.

10. A granular composition as claimed in claim 9 which, on contact with water, disperses to such an extent that from 50% by weight will pass through a 212 micron sieve.

11. A granular composition as claimed in claim 9 which, on contact with water, disperses to such an extent that from 60% to 95% by weight will pass through a 212 micron sieve.

12. A granular composition as claimed in claim 9 in which the dispersing agent is present in an amount of from 2 to 20% by weight of the composition.

13. A granular composition as claimed in claim 9 in which the dispersing agent is in the form of a water swelling organic particulate material.

14. A granular composition as claimed in claim 13 in which said particulate material has a water swelling capacity of at least 10 ml/g.

15. A granular composition as claimed in claim 13 in which said particulate material has a water swelling capacity of at least 15 ml/g.

16. A granular composition as claimed in claim 13 in which said particulate material has a water swelling capacity of at least 20 ml/g.

17. A granular composition as claimed in claim 13 in which the organic particulate comprises a sodium starch glycolate, a sodium polyacrylate, a cross-linked sodium carboxymethylcellulose or a mixture thereof.

18. A granular composition as claimed in claim 13 in which the particle size of the water swelling organic particulate is less than 100 microns prior to swelling.

19. A granular composition as claimed in claim 1 in which the functional ingredient comprises a perfume.

20. A granular composition according to claim 1 comprising granules of inorganic material carrying a liquid phase, substantially water-free volatile organic functional ingredient, the granules having a functional ingredient retention capability such that about 85% by weight of the functional ingredient content in the granule composition is retained upon exposure of the granule composition to a sub-atmospheric pressure of about 10 mbar for a period of 24 hours.

21. A granular composition as claimed in claim 20 in which the granules have a functional ingredient retention capability such that about 90% to about 100% by weight of the perfume content in the granule composition is retained upon exposure of the granule composition to said sub-atmospheric pressure for a period of 24 hours.

22. A laundry detergent powder comprising a granular composition as claimed in claim 1.

23. A laundry detergent powder as claimed in claim 22 in which the amount of detergent is between 8% and 20% by weight.

24. A laundry detergent powder as claimed in claim 22 in which the amount of detergent is between 15% and 60% by weight.

25. A granular composition as claimed in claim 1 wherein the amorphous silica has a particle size of no more than 40 microns and the granules have a particle size greater than from 400 to 1200 microns and a dry strength such that no more than 25% by weight pass through said 212 micron sieve.

26. A granular composition as claimed in claim 1 wherein the amorphous silica has a particle size of no more than 30 microns and the granules have a particle size greater than from 400 to 1200 microns and a dry strength such that no more than 20% by weight pass through said 212 micron sieve.

27. A process for the production of a granular composition for carrying and retaining a liquid phase, substantially water-free, volatile organic functional ingredient, the composition comprising at least 40% by weight of amorphous silica having a surface area of at least 550 $m^2/g$, a pore volume from about 1.0 to about 2.5 ml/g and a particle size of no more than 50 microns, which comprises agglomerating the amorphous silica to form granules, the granules of said composition having:

a particle size greater than 200 up to 2000 microns; and a dry strength such that no more than 30% by weight pass through a 212 micron sieve when subjected to the attrition test defined herein.

28. A laundry detergent powder as claimed in claim 22 in which said functional ingredient comprises a perfume in an amount within the range 0.05 to 2.5% by weight of the powder.

29. A process as claimed in claim 27 in which a liquid phase, substantially water-free, volatile organic functional ingredient is thereafter mixed with the granules.

30. A process as claimed in claim 29 wherein the liquid phase ingredient is a perfume.

31. A process as claimed in claim 29 in which the granules formed prior to addition of the functional ingredient are free flowing and in which the amount of functional ingredient mixed with the granules is limited to an amount which permits retention of free flowability of the functional ingredient carrying granules.

32. A process as claimed in claim 31 in which the functional ingredient comprises a perfume.

33. A process as claimed in claim 28 wherein the dry strength of said granules is such that no more than 25% by weight pass through said 212 sieve.

34. A process as claimed in claim 28 wherein the dry strength of said granules is such that no more than 20% by weight pass through said 212 sieve.

* * * * *